US006928750B2

(12) United States Patent
Kashkoush et al.

(10) Patent No.: US 6,928,750 B2
(45) Date of Patent: Aug. 16, 2005

(54) MEMBRANE DRYER

(75) Inventors: Ismail Kashkoush, Orefield, PA (US); Richard Novak, Plymouth, MN (US); Larry Myland, West Chester, PA (US)

(73) Assignee: Akrion, LLC, Allentown, PA (US)

( * ) Notice: Subject to any disclaimer, the term of this patent is extended or adjusted under 35 U.S.C. 154(b) by 0 days.

(21) Appl. No.: 10/951,009

(22) Filed: Sep. 27, 2004

(65) Prior Publication Data

US 2005/0087303 A1 Apr. 28, 2005

Related U.S. Application Data

(62) Division of application No. 10/117,739, filed on Apr. 5, 2002, now Pat. No. 6,842,998.

(60) Provisional application No. 60/282,399, filed on Apr. 6, 2001.

(51) Int. Cl.[7] ..... F26B 21/00

(52) U.S. Cl. ..... 34/548; 34/549; 34/570; 34/72; 34/78; 34/82; 261/104; 261/107; 96/10

(58) Field of Search ..... 261/104, 107; 34/78, 82, 548, 549, 570, 72; 95/8, 12, 45; 96/10; 210/640, 96.2

(56) References Cited

U.S. PATENT DOCUMENTS 4,545,862 A 10/1985 Gore et al.
4,851,125 A 7/1989 Dotson et al.
4,917,123 A 4/1990 McConnell et al.
4,936,877 A 6/1990 Hultquist et al.
5,013,447 A 5/1991 Lee et al.
5,138,105 A 8/1992 Ninomiya et al.

(Continued)

FOREIGN PATENT DOCUMENTS

EP 0 284 052 A2 9/1988
JP 1-297106 A 11/1989
JP 63-11909 A 5/1998
WO WO00/22654 4/2000

*Primary Examiner*—Richard Bueker
(74) *Attorney, Agent, or Firm*—Michael B. Fein, Esq.; Brian L. Belles, Esq.; Cozen O'Connor, P.C.

(57) ABSTRACT

A system, method, and apparatus for supplying a gas-liquid vapor to a process tank for performing semiconductor manufacturing. In one aspect, the invention is a method of supplying a gas-liquid vapor to a process tank comprising: supplying a gas stream through at least one hydrophobic tube; exposing the outside surface of the hydrophobic tube to a liquid so that a vapor of the liquid permeates the hydrophobic tube and enters the gas stream, forming a gas-liquid vapor inside the tube; and transporting the gas-liquid vapor to the process tank. In another aspect, the invention is an apparatus for supplying a gas-liquid vapor to a process tank comprising: at least one hydrophobic tube adapted to carry a gas; and a housing forming a chamber that surrounds the tube, the chamber adapted to receive a liquid that can permeate the tube, forming a gas-liquid vapor. In yet another aspect, the invention is a system for supplying a gas-liquid vapor to a process tank comprising: the apparatus of the present invention; gas supply means adapted to supply the gas to the tube; liquid supply means adapted to supply the liquid to the chamber; and gas-liquid transport means adapted to carry the gas-fluid vapor from the apparatus to the process tank.

14 Claims, 3 Drawing Sheets

U.S. PATENT DOCUMENTS 5,243,768 A * 9/1993 Fukao et al. ..... 34/443
5,368,786 A 11/1994 Dinauer
5,582,721 A * 12/1996 Mita et al. ..... 210/181
5,585,527 A 12/1996 Market
5,868,906 A 2/1999 Adams
5,996,976 A 12/1999 Murphy
6,182,951 B1 2/2001 Hallman et al.
6,210,464 B1 4/2001 Nakanishi et al.

* cited by examiner

MEMBRANE DRYER

CROSS-REFERENCE TO RELATED APPLICATIONS

The present application is a divisional application of United States Nonprovisional patent application Ser. No. 10/117,739, filed Apr. 5, 2002, now U.S. Pat. No. 6,842,998, which claims the benefit of U.S. Provisional Application 60/282,399, filed Apr. 6, 2001, both of which are incorporated by reference herein in their entireties.

BACKGROUND OF THE INVENTION

This invention relates generally to the field of manufacturing substrates and specifically to methods and apparatus for providing a gas-liquid vapor to a process tank.

In the manufacture of semiconductors, semiconductor devices are produced on thin disk-like objects called wafers. Generally, each wafer contains a plurality of semiconductor devices. In producing semiconductor devices, wafers are subjects to a multitude of processing steps before a viable end product can be produced. These processing steps include: chemical-etching, wafer grinding, photoresist stripping, masking, cleaning, rinsing, and drying. Many of these steps require that the wafer be subjected to one or more chemicals. These steps typically occur in a process tank. The chemicals used to process the wafers come in a variety of phases and combinations, including: liquid, gas, liquid-liquid mixtures; gas dissolved in a liquid; and gas-liquid vapors.

A particularly important process step in the wafer manufacturing process is the drying step. A such, a multitude of methods and apparatus exist for use in this process. In order to dry wafers after cleaning, many of these methods and apparatus apply Marangoni-style techniques. In utilizing, Marangoni-style drying techniques, the surfaces of the wafers are exposed to a gas-liquid vapor comprising nitrogen ($N_2$) and isopropyl alcohol (IPA). This typically occurs by blowing the $N_2$-IPA vapor over the wafer surfaces. Exposing the surfaces of the wafers to the $N_2$-IPA vapor speeds up the evaporation of any liquids left on the wafer surfaces. As such, enhanced drying occurs at a faster rate. However, because drying typically occurs after cleaning the wafers, it is imperative that the wafers not be contaminated during the drying process. Additionally, because the rate of drying is related to the concentration ratio of IPA and $N_2$ in the $N_2$-IPA vapor, it is important that this ratio be controlled during the drying process.

Current systems, apparatus, and methods fail to achieve these objectives. In existing systems, the $N_2$-IPA vapor that is used to dry the wafers is created by bubbling $N_2$ into a liquid bath of IPA. The $N_2$ then escapes from the IPA bath carrying IPA vapor with it. This $N_2$-IPA vapor is then transported to the process tank to the dry the wafers. However, it is often the case that the IPA liquid contains contaminants. Thus, because the $N_2$ gas comes into direct contact with the IPA liquid, some of these contaminants will be carried with the $N_2$-IPA vapor and subsequently contact the wafer surfaces. As such, the wafers become contaminated after cleaning, resulting in failed devices and lower yields.

An additional problem of current drying systems using $N_2$-IPA vapor is that there is currently no way to control the concentration ratio of $N_2$ and IPA in the $N_2$-IPA vapor as it enters the process tank. If the $N_2$-IPA vapor is not fully saturated with IPA, a less than optimal cleaning effect will result. Prior art methods and apparatus rely on the fact that the $N_2$ gas will become fully saturated as it passe through the liquid IPA. However, because the saturation method is unpredictable and ineffective, this is not always the case. As such, the wafers can be left "wet" or drying time will be increased. Leaving the wafers "wet" will cause devices fail. Moreover, if a lesser level of IPA is needed in the $N_2$-IPA vapor than that which is being supplied to dry the wafers, IPA is being wasted. Thus, a need exists to be able to control the level of IPA in the $N_2$-IPA vapor.

SUMMARY OF THE INVENTION

These problems and others are met by the present invention which in one aspect is a method of supplying a gas-liquid vapor to a process tank comprising: supplying a gas stream through at least one hydrophobic tube; and exposing the outside surface of the hydrophobic tube to a liquid so that the liquid permeates the hydrophobic tube and enters the gas stream, forming a gas-liquid vapor inside the tube.

It is preferable that the gas-liquid vapor be produced within the process tank. However, if the gas-liquid vapor is produced before reaching the process tank, the method further comprises the step of transporting the gas-liquid vapor to the process tank.

Preferably, the liquid is a low surface tension liquid. The hydrophobic tube can be constructed of a flouroploymer such as PFA, PTFE, or PVDF. Also preferably, when the liquid is exposed to the outside surface of the tube, the liquid is placed under pressure. If necessary, the gas can be heated.

It is preferable for the method of invention to further comprise the step of adjusting the concentration ratio of gas to liquid in the gas-liquid vapor to a predetermined ratio. This can be done by adjusting the mass flow rate of the gas or by adjusting the pressure of the liquid at the point where the liquid is exposed to the outside of the tube.

While the method of the present invention can be used for any gas-liquid vapor used in processing semi-conductor wafers, it is preferable that the gas is nitrogen and the liquid is isopropyl alcohol. This is because the need for this invention is most prevalent in the drying step.

In another aspect, the invention is an apparatus for supplying a gas-liquid vapor to a process tank comprising: at least one hydrophobic tube adapted to carry a gas; and a housing forming a chamber that surrounds the tube, the chamber adapted to receive a liquid that can permeate the tube, forming a gas-liquid vapor.

Preferably, the hydrophobic tube is constructed of a flouropolymer such as PFA, PTFE, or PVDF.

In yet another aspect, the invention is a system for supplying a gas-liquid vapor to a process tank comprising: the apparatus described above; gas supply means adapted to supply the gas to the tube; and liquid supply means adapted to supply the liquid to the chamber.

It is preferable that the gas-liquid vapor be produced within the process tank. However, if the gas-liquid vapor is produced before reaching the process tank, the system further comprises gas-liquid vapor transport means adapted to carry the gas-fluid vapor from the apparatus to the process tank.

Preferably, the system further comprises means to control the mass flow rate of the gas through the gas supply means. Also preferably, the system comprises means to control pressure of the liquid when the liquid is in the chamber.

Furthermore, the system preferably comprises a concentration sensor adapted to measure the concentration ratio of the gas-liquid vapor. In this embodiment, the concentration sensor can be adapted to control the mass flow rate of the gas through the gas supply means or adapted to control pressure of the liquid in the chamber.

Finally, it is preferable that the system further comprise a heater adapted to heat the gas prior to entering the apparatus.

DETAILED DESCRIPTION OF THE DRAWINGS

Figure 1:
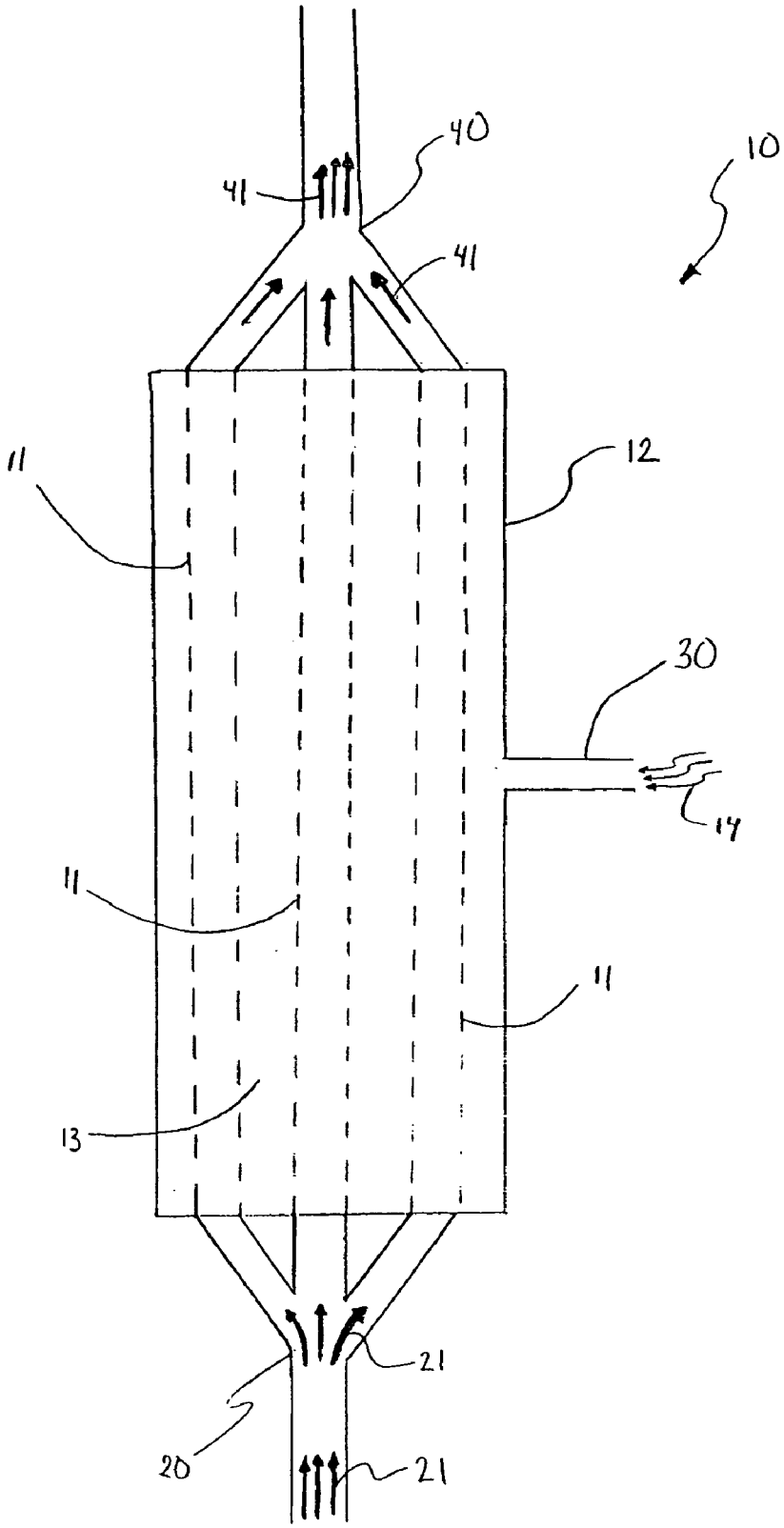
FIG. 1 is top view of an embodiment of the apparatus of the present invention, a membrane dryer.

FIG. 1 illustrates a top view of an embodiment of the apparatus of the present invention, membrane dryer 10 connected to gas supply line 20, liquid supply line 30, and gas-liquid vapor transport line 40. Membrane dryer 10 comprises hydrophobic tubes 11 and housing 12.

Figure 2:
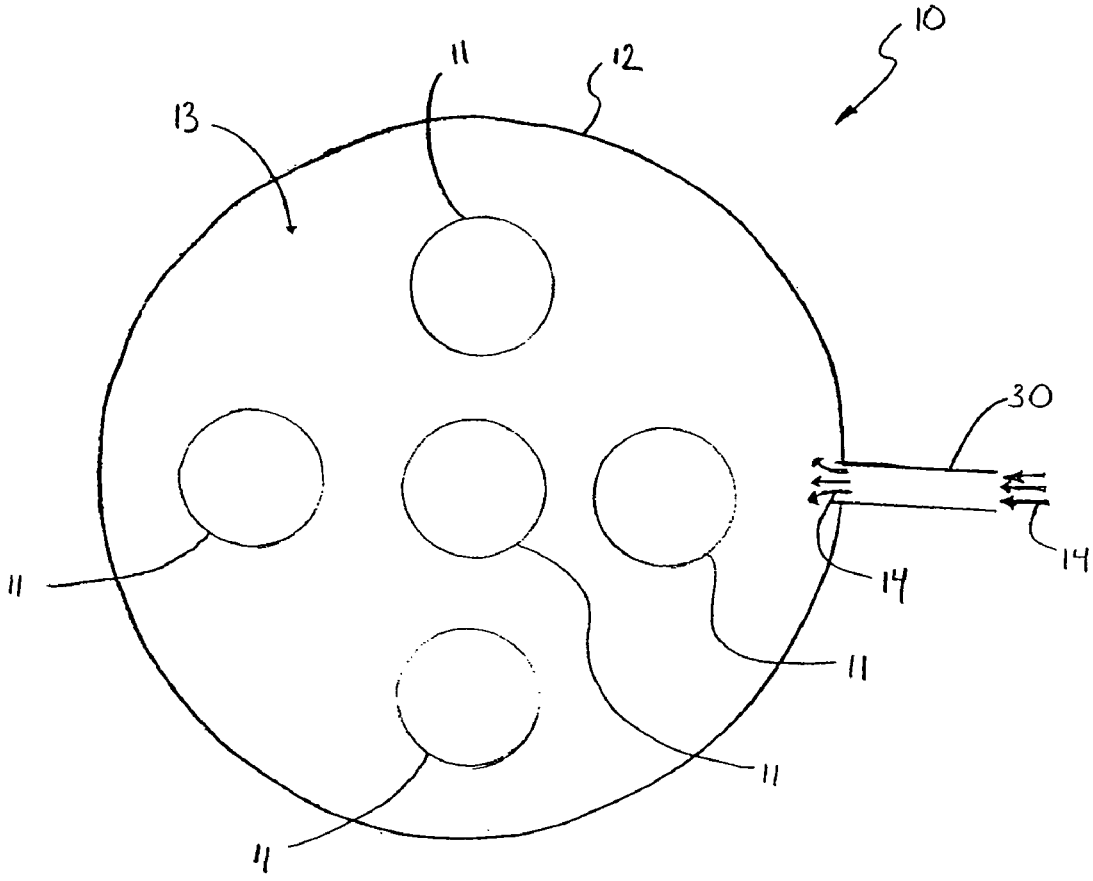
FIG. 2 is a cross-sectional view of the membrane dryer.

Referring to FIG. 2, housing 12 surrounds hydrophobic tubes 11 so as to form a hermetically sealed chamber 13 that can receive and hold liquid supplied through liquid supply line 30. The liquid enters chamber 13 as indicated by arrows 14. When chamber 13 is filled with liquid, the liquid is contact with and surrounds the outer surface of hydrophobic tubes 11.

Figure 3:
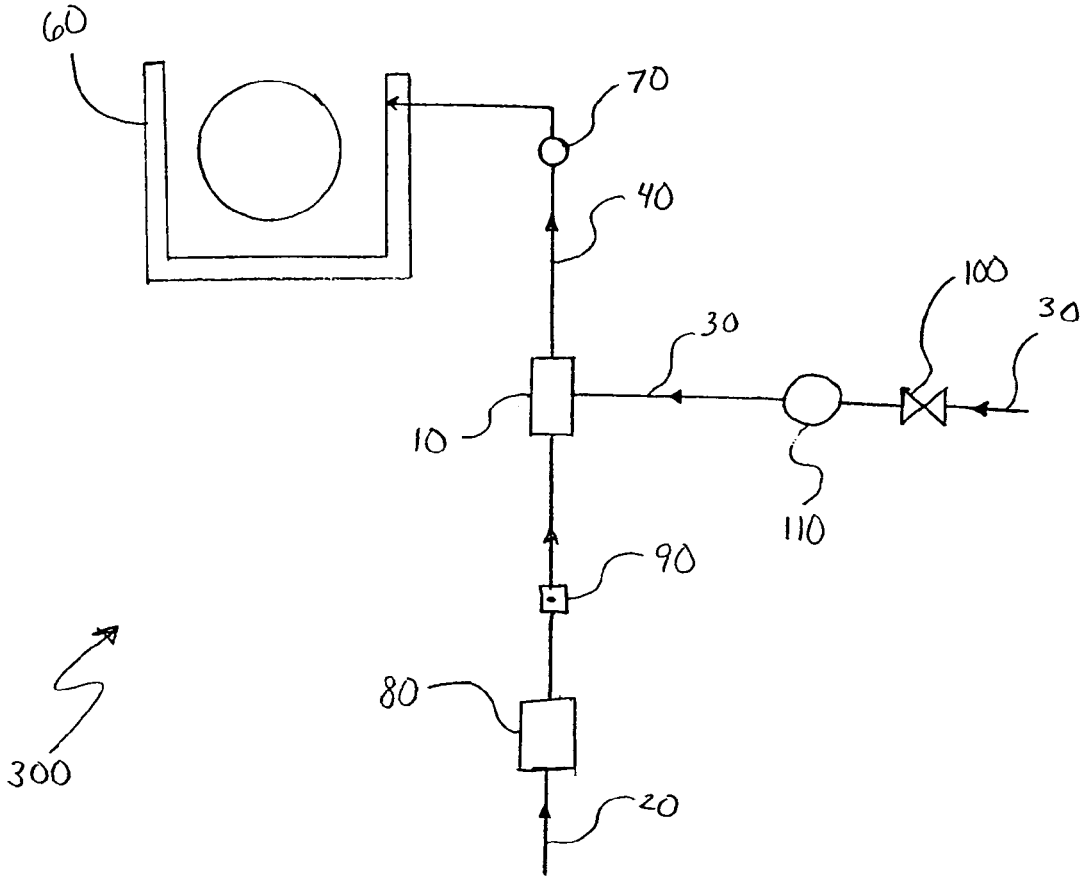
FIG. 3 is an embodiment of the system of the present invention set up to supply gas-liquid vapor to a process tank in accordance with the present invention.

Referring back to FIG. 1, hydrophobic tubes 11 are fluidly connected to gas supply line 20. Gas supply line 20 is also fluidly connected to a gas reservoir (not shown). As such, gas supply line 20 supplies a predetermined gas to hydrophobic tubes 11. This is indicated by arrows 21. In the illustrated embodiment, hydrophobic tubes 11 are also fluidly connected to gas-liquid vapor transport line 40 on the other end of membrane dryer 10. Gas-liquid vapor transport line 40 is used to transport the gas-liquid vapor which is formed in membrane dryer 10 to process tank 60 (FIG. 3).

While in the illustrated embodiment, gas-liquid vapor transport line 40 is needed because membrane dryer 10 is located in dryer system 300 prior to process tank, it is possible to place membrane dryer 10 directly in process tank 60. As such, the gas-liquid vapor will be created in the process tank 60 (i.e. the point of use). If membrane dryer 10 is positioned in process tank 60 for point of use vapor production, gas-liquid vapor transport line 40 is not needed. Instead, hydrophobic tubes 11 are open and freely introduce gas-liquid vapor into process tank 60.

Hydrophobic tubes 11 are very thin hydrophobic tubular membranes constructed of a flouropolymer. Acceptable flouropolymer materials include PFA, PTFE, and PVDF. The thickness of the hydrophobic membrane is in the range between 50–500 microns. Housing 12 is also constructed of a suitable flouropolymer. However, the thickness of housing 13 is much thicker. The exact thickness of housing 13 will depend on the pressure requirements needed by the system. As a result of hydrophobic tube 13 being a very thin membrane, when chamber 13 is filled with a liquid, liquid vapor can permeate through the hydrophobic tubes 11. Hydrophobic tubes 11 act as filters in that they only allow pure liquid vapor to permeate through. The liquid itself never contacts the gas stream. As such, only the pure liquid vapor that permeated the tubes 11 enters the gas stream. All contaminants are blocked by the hydrophobic membrane that is hydrophobic tubes 11.

The rate at which the liquid vapor permeates through hydrophobic tubes 11 increases when the liquid is under increased pressure. This permeation rate will also increase as a result of the liquid having the chemical property of a lower surface tension. As gas is flowed through hydrophobic tubes 11, this permeated liquid vapor will be carries away in the gas stream, forming a gas-liquid vapor. Permeation will occur as long as there is a concentration differential between the liquid and the gas and the gas is not saturated.

Referring to FIG. 3, an embodiment of the system of the present invention is shown using membrane dryer 10. In the illustrated embodiment, dryer system 300 comprises membrane dryer 10, process tank 60 having wafer 50, concentration sensor 70, heater 80, gas mass flow controller 90, liquid pressure regulator 100, and liquid flow meter 110.

In using system 300 according to the method of the present invention, $N_2$ gas is supplied to membrane dryer 10 by gas supply line 20. Gas supply line 20 feeds from a $N_2$ reservoir at variable pressures. In supplying $N_2$ to membrane dryer 10, gas supply line 20 passes the $N_2$ flow through heater 80 and mass flow controller 90. If necessary, heater 80 can heat the $N_2$ gas it passes through. Because the $N_2$ reservoir supplies $N_2$ at variable pressure, gas mass flow controller 90 can be used to provide a steady flow of $N_2$ to membrane dryer 10. Gas mass flow controller 20 can be coupled to a properly programmed processor which in turn can be coupled to concentration sensor 70. As such, the mass flow of $N_2$ can be controlled in order to control the concentration ratio of the $N_2$-IPA vapor entering process tank 60. This will be described in more detail below. Moreover, those skilled in the art will appreciate that a mass flow controller can be replaced by a flow meter and a pressure regulator in series to achieve the same goals.

Additionally, system 300 comprises liquid supply line 30 that supplies liquid IPA to membrane dryer 10. Liquid supply line 20 is equipped with liquid pressure regulator 100 and liquid flow meter 110. Liquid pressure regulator 100 and liquid flow meter 110 can control the liquid mass flow rate into membrane dryer 10. As such, regulator 100 and meter 110 can be coupled to a properly programmed processor which in turn can be coupled to concentration sensor 70. As such, concentration sensor 70 can facilitate control of the IPA mass flow rate into membrane dryer, and a such can control the liquid pressure within chamber 13 (FIG. 2).

Once within membrane dryer 10, the IPA liquid fills chamber 13 while the $N_2$ gas passes through hydrophobic tubes 11. As described in detail above, ultra-pure IPA vapor will pass through tubes 11 and be carried away by the $N_2$, forming $N_2$-IPA vapor. This $N_2$-IPA vapor is carried to process tank 60 via gas-liquid transporter line 40 where it contacts and dries wafer 50. Alternatively, membrane dryer 10 can be placed within process tank 60 as described above. Because membrane dryer 10 uses permeation of IPA vapor to supply the $N_2$ gas with IPA, the liquid IPA and the $N_2$ gas never contact one another. As such, there is no danger of contaminating the $N_2$-IPA vapor that will contact the wafers 50.

As the $N_2$-IPA vapor is formed and transported to process tank 60, it passes through concentration sensor 70. Concentration sensor 70 measures the concentration levels of the $N_2$ gas and the IPA vapor in the $N_2$-IPA vapor mix. Concentration sensor does this by using conductivity principles. Concentration sensor 70 can be electrically coupled to a properly programmed processor which in turn can be coupled to either gas mass flow controller 90 or pressure regulator 100 and flow meter 110. As such, concentration sensor 70 communicates data to the processor, which can be an Intel Pentium processor in a PC. The processor analyzes this data to see if it matches variables entered by an operator that determine a desired concentration ratio of the $N_2$-IPA vapor. If the concentration sensor data does not match the predetermined concentration ratio data, the processor will communicate with and adjust either gas mass flow controller 90 or liquid pressure regulator 100 accordingly. As discussed earlier, by increasing the pressure in chamber 13, more IPA vapor will permeate into the $N_2$-IPA vapor stream. Thus, increasing the IPA concentration. As such, if the pressure in chamber 13 is decreased, so will the level of the IPA in the $N_2$-IPA vapor. Gas mass flow rate 90 can control the concentration ratio of the $N_2$-IPA vapor using similar principles.

The foregoing discussion discloses and describes merely exemplary embodiments of the present invention. As will be understood by those skilled in this art, the invention may be embodied in other specific forms without departing from the spirit or essential characteristics thereof. Accordingly, the disclosure of the present invention is intended to be illustrative, but not limiting, of the scope of the invention, which is set forth in the following claims. Specifically, the method, system, and apparatus claimed herein can be used to provide a gas-liquid vapor of any chemical composition in accordance with the inventive principles disclosed herein. As such, the invention is not limited to the step of drying.

What is claimed is:

1. A system for drying a wet substrate with a mixture of gas and vaporized liquid comprising:

a process tank having a wet substrate to be dried by contact with said mixture supported therein;

a gas source;

a liquid isopropyl alcohol source;

at least one hydrophobic tube fluidly connected to the gas source, the hydrophobic tube being impermeable to said liquid but permeable to the vapor of said liquid;

a housing forming a chamber that surrounds the tube, the chamber fluidly connected to the liquid source;

means for supplying the gas to the at least one hydrophobic tube from the gas source;

means for supplying the liquid to the chamber from the liquid source, a vapor of the liquid permeating the at least one hydrophobic tube and forming a mixture of the gas and vaporized liquid in the at least one hydrophobic tube; and means for transporting said mixture from the inside of the hydrophobic tube to the wet substrate supported in the process chamber.

2. The system of claim 1 wherein the hydrophobic tube is constructed of a flouropolymer.

3. The system of claim 2 wherein the flouropolymer is selected form the group consisting PFA, PTFE, or PVDF.

4. The system of claim 1 wherein the housing is located within the process tank, the mixture being created within the process tank.

5. The system of claim 1 further comprising a transport line for transporting the mixture from the hydrophobic tube to the process tank.

6. The system of claim 1 further comprising means to control the mass flow rate of the gas through the gas supply means.

7. The system of claim 1 further comprising means to control pressure of the liquid when the liquid is in the chamber.

8. The system of claim 1 further comprising:

a concentration sensor adapted to measure the concentration ratio of the mixture;

means to adjust the concentration ratio of the mixture; and a processor coupled to the concentration sensor and the adjustment means, the processor programmed to activate the adjustment means in response to data received from the concentration sensor to achieve a predetermined concentration ratio in the mixture.

9. The system of claim 8 wherein the adjustment means is adapted to control the mass flow rate of the gas through the gas supply means.

10. The system of claim 8 wherein the adjustment means is adapted to control pressure of the liquid in the chamber.

11. The system of claim 1 comprising a heater adapted to heat the gas prior to the gas combining with the vaporized liquid to form the mixture.

12. The system of claim 1 wherein the substrate is a semiconductor wafer.

13. The system of claim 1 comprising a plurality of the hydrophobic tubes within the chamber of the housing.

14. The system of claim 13 wherein the number of hydrophobic tubes is three.

* * * * *